US006038796A

United States Patent [19]

Uchikoshi

[11] Patent Number: 6,038,796

[45] Date of Patent: Mar. 21, 2000

[54] PRESSING MACHINE FOR TROUSERS

[75] Inventor: Mitsuyuki Uchikoshi, Tokyo, Japan

[73] Assignee: Sankousha Co., Ltd., Tokyo, Japan

[21] Appl. No.: 09/152,911

[22] Filed: Sep. 14, 1998

[51] Int. Cl.[7] ..... D06F 71/08

[52] U.S. Cl. ..... 38/20; 38/35

[58] Field of Search ..... 38/20, 21, 23, 38/25, 31, 34, 35; 100/237

[56] References Cited

U.S. PATENT DOCUMENTS

| | | | |
|---|---|---|---|
| 2,475,304 | 7/1949 | Bariffi | 38/25 |
| 3,500,567 | 3/1970 | Tucker et al. | 38/35 |
| 4,280,290 | 7/1981 | Andersson | 38/31 |
| 4,542,601 | 9/1985 | Cartabbia | 38/20 X |
| 5,014,453 | 5/1991 | Gratsch | 38/20 X |
| 5,452,530 | 9/1995 | Cartabbia | 38/20 |

FOREIGN PATENT DOCUMENTS

| | | | |
|---|---|---|---|
| 2529236 | 12/1983 | France | 38/20 |
| 8707661 | 12/1987 | WIPO | 38/20 |

*Primary Examiner*—Ismael Izaguirre
*Attorney, Agent, or Firm*—Andrus Sceales Starke & Sawall

[57] ABSTRACT

This invention is formed such that the pressing table is formed by a pair of front-side pressing table and rear-side pressing table. This invention is also formed such that the pressing iron is formed by a pair of front-side pressing iron corresponding to the front-side pressing table and a rear-side pressing iron corresponding to the rear-side pressing table. Then, this invention is constructed such that the front-side pressing table and the rear-side pressing table are arranged side-by-side with a clearance being applied to arrange the overlapped portions of cloth. Further, this invention is provided with an operating mechanism for making a slight rearward positional displacement of both the rear-side pressing table and the rear-side pressing iron so as to make a taught state of the trousers during pressing of the trousers.

2 Claims, 7 Drawing Sheets

PRESSING MACHINE FOR TROUSERS

BACKGROUND OF THE INVENTION

1. Field of the Invention

This invention relates to a pressing machine for press finishing clothes and more particularly a pressing machine for trousers.

2. Description of the Prior Art

As such a type of this machine in the prior art, there is provided an invention described in the official gazette of U.S. Pat. No. 5,711,097, for example. This machine of the prior art is formed such that the trousers is suspended in a vertical orientation and the trousers is pressed with operating panels arranged at both sides.

As shown in FIGS. 1B and 4, the trousers normally has an overlapped portion 11 of the clothes extending along its length. The overlapped portion 11 becomes thick and is formed into a stepped state because the clothes are bent back inwardly.

Accordingly, it is preferable that this type of machine is formed in such a way that the press finishing can be carried out for a location except the aforesaid overlapped portion 11. Because, when the entire trousers including the aforesaid overlapped portion 11 is pressed, a pressing pressure is strongly applied to the overlapped portion 11 so as to damage the surface of the clothes at the overlapped portion 11 and then the entire trousers can not be press finished in a neat state.

However, the prior art machine was operated such that the entire trousers including the aforesaid overlapped portion 11 was press finished by a pressing iron. Accordingly, according to this type of machine, there occurred a problem that a strong pressing pressure is applied to the overlapped portion 11 of the clothes, resulting in that the clothes at the surface side of the overlapped portion 11 is damaged and the trousers can not be pressed in a neat state.

In addition, this type of machine is preferably formed such that a pressing operation can be carried out while the clothes are being kept taut in such a way that the finished state of the legs of the trousers may become more neat.

However, the prior art machine was operated such that the legs of the trousers are pressed as they are. Accordingly, application of the prior art machine caused a press line to be easily applied due to the step of the overlapped portion 11, resulting in that the legs of the trousers could not be finished neat.

The present invention eliminates such problems of the prior art.

Accordingly, a technical problem of the present invention provides a pressing machine for trousers in which the trousers can be pressed except aforesaid overlapped portion 11 so as to enable the trousers to be neatly press finished and also during the pressing operation, the pressing can be performed under a state in which the clothes of the legs are being kept taut.

SUMMARY OF THE INVENTION

In the present invention, the pressing table for use in mounting a trousers thereon is formed by a pair of a front-side pressing table and a rear-side pressing table. Further, in the present invention, the pressing iron is formed by a pair of a front-side pressing iron corresponding to the front-side pressing table and a rear-side pressing iron corresponding to the rear-side pressing table. Then, the present invention has a feature in which the front-side pressing table and the rear-side pressing table are arranged side-by-side with a clearance being applied for arranging the overlapped portion of the clothes.

Accordingly, in case of the present invention, the overlapped portion of the clothes is arranged at the aforesaid clearance and then a pressing is operated under this state. Due to this fact, according to the present invention, the pressing finish can be carried out without damaging the clothes at the surface of the overlapped portion.

In the present invention, there is provided an operating mechanism for displacing the rear-side pressing table and the rear-side pressing iron in a rearward direction and keeping the trousers taught during the pressing operation for the trousers.

Accordingly, in the present invention, the clothes at the legs can be kept taut, so that the legs of the trousers can be press finished more neat.

In addition, as the operating source for the operating mechanism, there is provided an air cylinder or a motor. In the case of the present invention, the operating mechanism may be formed of a system in which only one operating source is provided or another system in which each of the rear-side pressing table and the rear-side pressing iron is provided with an exclusive operating source as disclosed in the preferred embodiment to be described later. In the case of latter, each of the operating sources is controlled in such a way that its operating state such as a starting state or a stopped state may become the same to each other.

BRIEF DESCRIPTION OF THE DRAWINGS

FIG. 1 illustrates one preferred embodiment of a machine of the present invention, wherein

DESCRIPTION OF THE PREFERRED EMBODIMENT

Figure 1A:
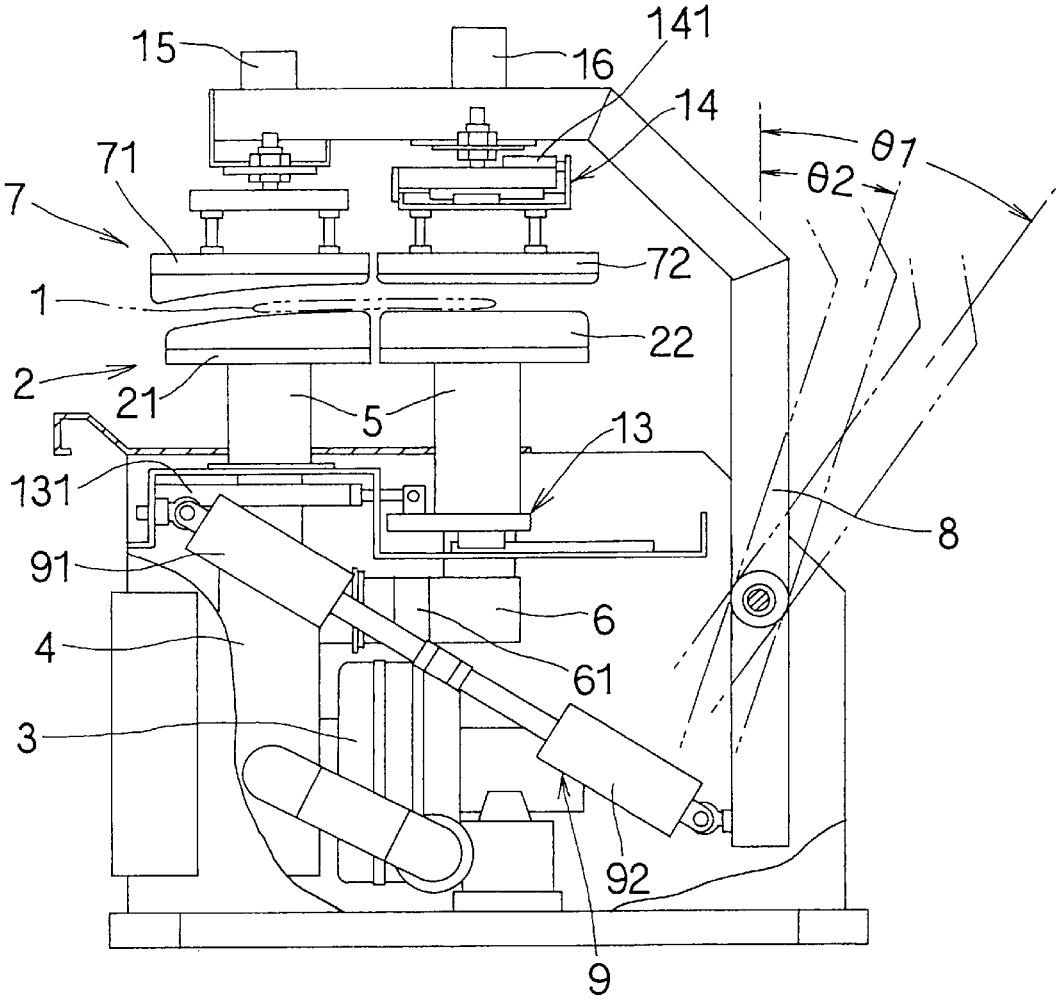
FIG. 1(A) is a side elevational view with a part being broken away and FIG. 1(B) is a perspective view for showing a substantial part of the present invention.

A preferred embodiment of the present invention will become more apparent from the following detailed description and the accompanying drawings.

In FIG. 1, reference numeral 1 denotes a trousers and reference numeral 2 denotes a press table for use in mounting the trousers 1. The press table 2 is formed by a pair of front-side press table 21 and rear-side press table 22.

Upper surfaces of the front-side press table 21 and the rear-side press table 22 are formed by some permeating materials. Reference numeral 3 denotes a blower for use in supplying heated air to both the front-side press table 21 and the rear-side press table 22. Reference numeral 4 denotes a heater. Hot air is supplied to both the front-side press table 21 and the rear-side press table 22 through the interior sections of the legs 5. Reference numeral 6 denotes an aeration passage ranging from the blower 3 to the rear-side press table 22. This aeration passage 6 is formed to be provided with an extendable or a retractable section 61 formed into a bellows.

Figure 1B:
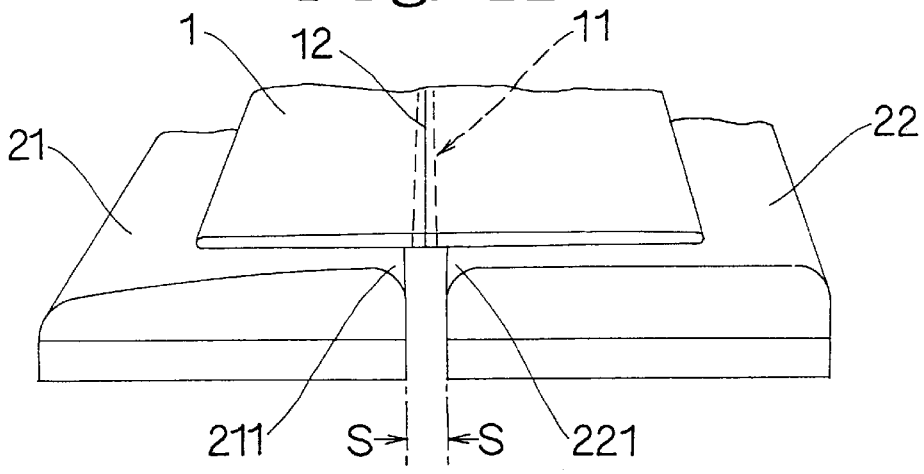
Figure 2:
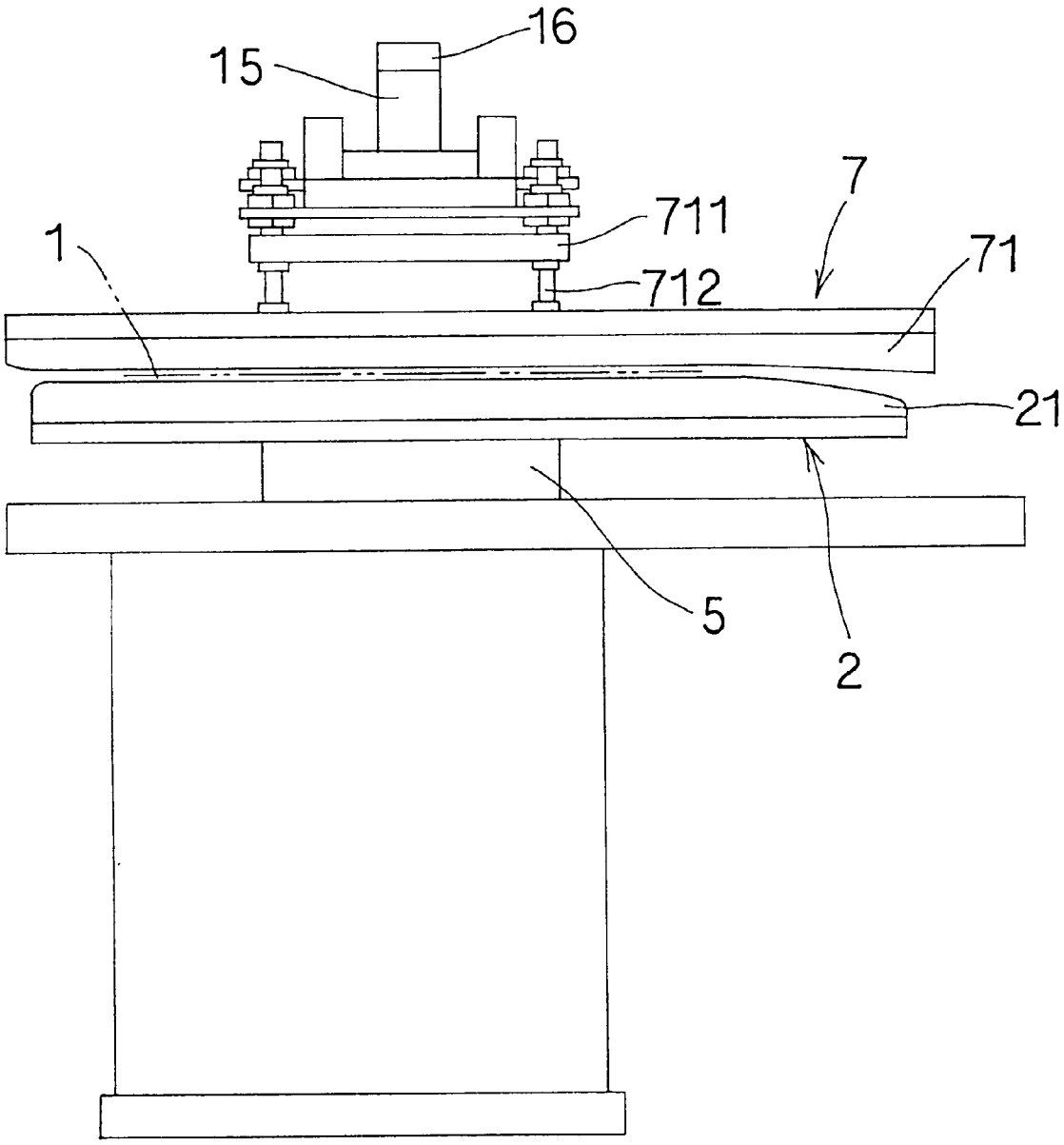
FIG. 2 is a front elevational view for showing the machine of FIG. 1.
Figure 3:
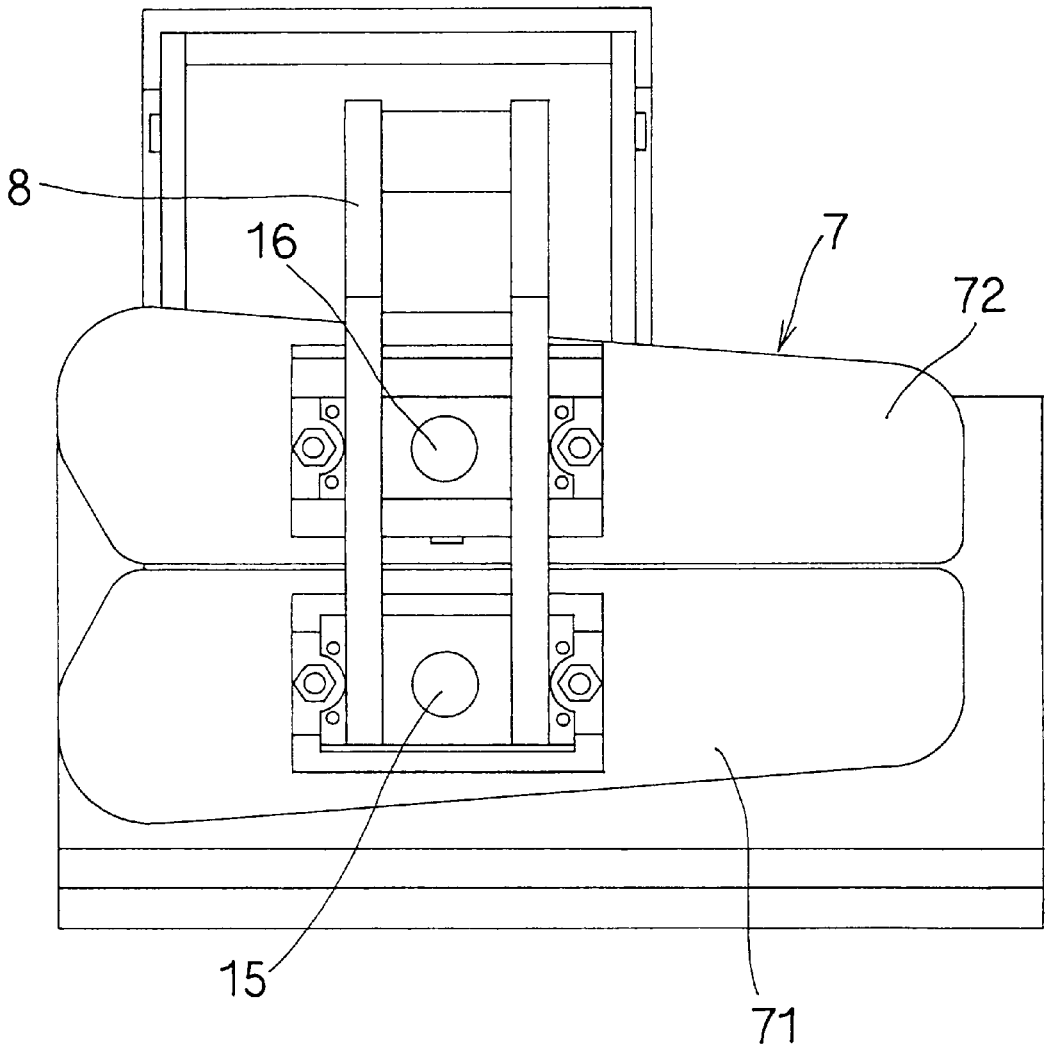
FIG.3 is a top plan view for showing the machine of FIG. 1.
Figure 4:
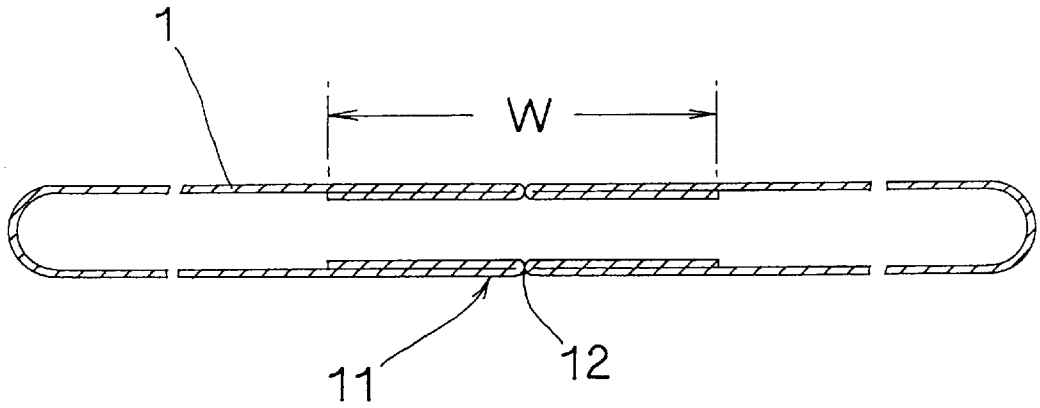
FIG. 4 is a sectional view for showing a substantial part of trousers.

In FIGS. 1B and 4, reference numeral 11 denotes overlapped portions of the trousers 1. The overlapped portions 11 are formed such that the clothes are bent back and formed along a length of the trousers 1. Reference numeral 12 denotes a seam. Reference symbol W denotes a lateral width W of the overlapped portions 11.

As shown in FIG. 1B, the front side press table 21 and the rear side press table 22 are arranged side by side in spaced apart relation of a clearance S in order to arrange the aforesaid overlapped portions 11. A width of this clearance S is selected to be about 10 (mm) in this preferred embodiment.

It is preferable that the width of the clearance S is properly selected in reference to the curved states of an upper edge 211 of the front-side press table 21 and an upper edge 221 of the rear-side press table 22. That is, this width is selected such that it is narrow in the case that the curved states of the upper edges 211, 221 are large and in turn selected to be wide when the curved states are low in such a way that the lateral width W of the overlapped portions is positively stored therein.

Reference numeral 7 denotes a press iron for use in pressurizing the upper surfaces of the aforesaid press table 2. This press iron 7 is formed by a pair of a front-side press iron 71 corresponding to the front-side press table 21 and a rear-side press iron 72 corresponding to the rear-side press table 22. Reference numeral 8 denotes a support which is pivoted in a forward or a rearward direction. The front-side press iron 71 and the rear-side press iron 72 are arranged at the upper part of the support 8.

Reference numeral 9 denotes a driving means for use in turning the support 8 in a forward or a rearward direction. This driving means is formed such that an extremity end of a rod member of one air cylinder 91 and an extremity end of a rod member of the other air cylinder 92 in this preferred embodiment are connected to each other. In this case, it has an advantage that a less-expensive air cylinder having a short stroke can be utilized.

In the case of the present invention based on this preferred embodiment, the support 8, as shown in FIG. 1A, is formed in such a way that it can be turned in a forward or a rearward direction with a large angle Ø1 and a small angle Ø2 under the operation of the driving means 9.

An opportunity in which the support 8 is turned only by the angle Ø2 corresponds to the case in which the trousers 1 is to be pressed. In this case, since the turning angle of the support 8 is small in its value, a fast and efficient pressing operation can be carried out.

Figure 7:
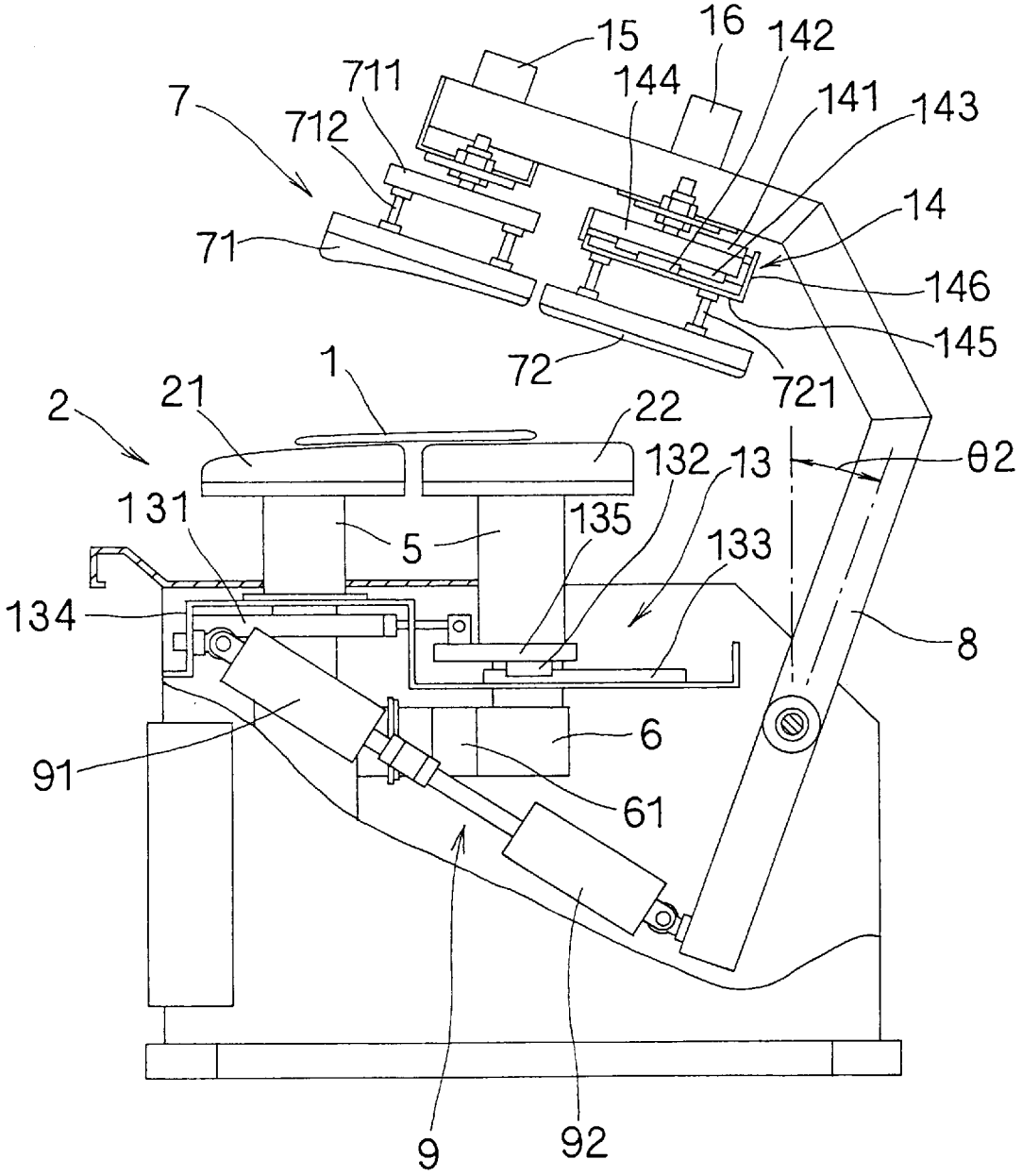
FIG. 7 is a side elevational view for showing an action of the machine shown in FIG. 1 with its part being broken away.

In this preferred embodiment, in the case that the support 8 is turned only by the angle Ø2, only the rod of the one air cylinder 91 is extended or retracted and the rod of the other air cylinder 92 is fixed in its extended state. As the rod of one air cylinder 91 is extended, the support 8 is raised as shown in FIG.1A and the press iron 7 is arranged just above the press table 2. In addition, as the rod of one air cylinder 91 is retracted, the support 8 is turned rearwardly only by the angle Ø2 as shown in FIG. 7.

Figure 8:
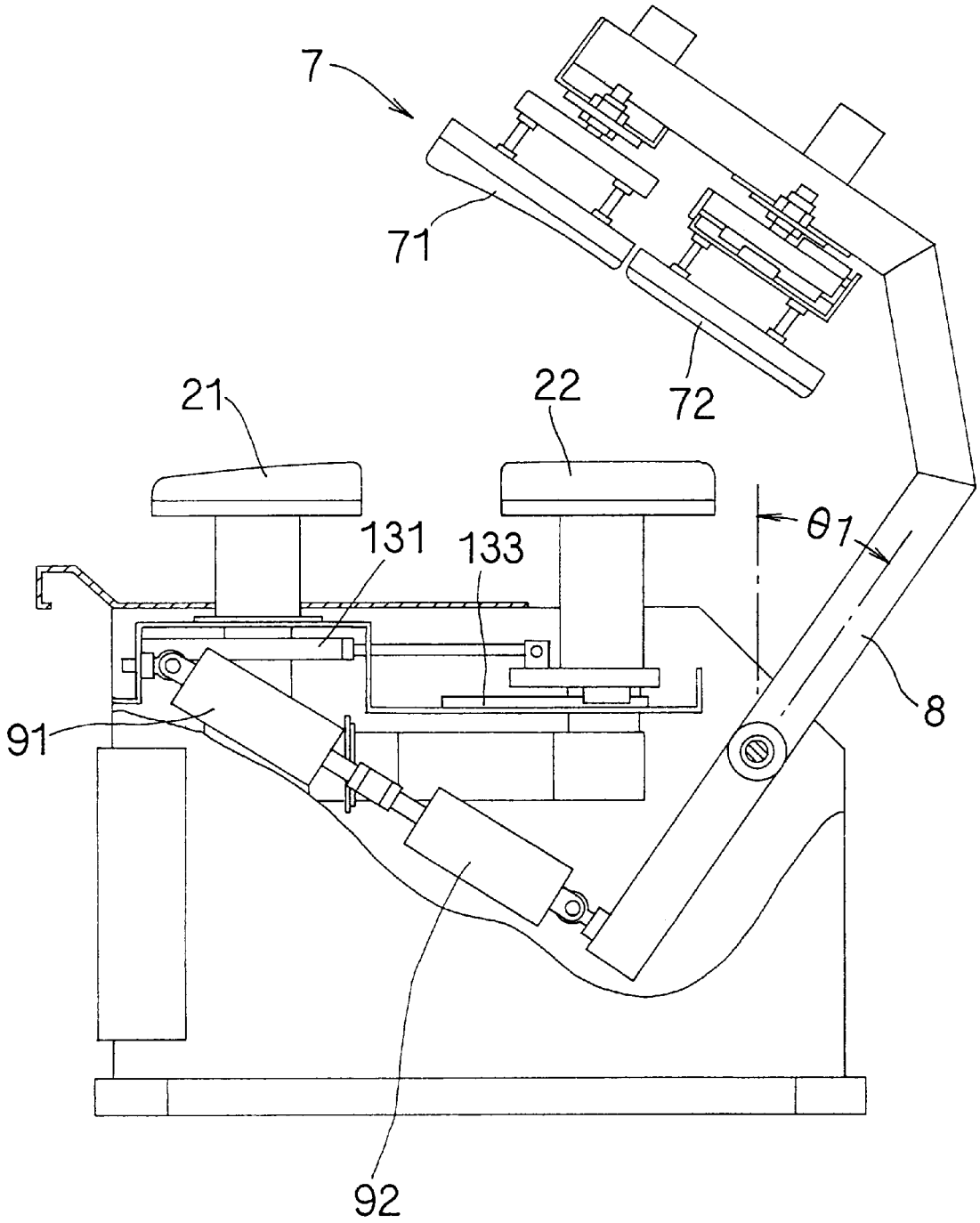
FIG. 8 is a side elevational view for showing an action of the machine shown in FIG. 1 with its part being broken away.

As shown in FIG. 8, the present invention is operated such that as the support 8 is turned rearwardly only by an angle Ø1, the upper portion of the front-side press table 21 is released. Accordingly, in this case, the front-side press table 21 can be utilized as an ironing table.

In the case that the support 8 is turned only by the angle Ø1, it is carried out with the rods of one air cylinder 91 and the other air cylinder 92 being extended or retracted. That is, as each of the rods of the air cylinders 91 and 92 is extended, the support 8 is raised as shown in FIG.1A, and the pressing iron 7 is arranged just above the press table 2. As each of the rods of the air cylinders 91 and 92 is retracted, the support 8 is turned wide rearwardly as shown in FIG. 8, resulting in that the pressing iron 7 is arranged at a rearward location.

Reference numeral 13 denotes an operating mechanism provided with an air cylinder 131 for use in sliding the rear-side pressing table 22 in a rearward direction. In addition, reference numeral 14 denotes an operating mechanism provided with an air cylinder 141 for use in sliding the rear-side pressing iron 72 in a rearward direction. The rear-side pressing table 22 and the rear-side pressing iron 72 are slightly displaced in a rearward direction by the operating mechanism 13 and the operating mechanism 14 during pressing the trousers 1 so as to keep the trousers 1 taut.

Figure 6:
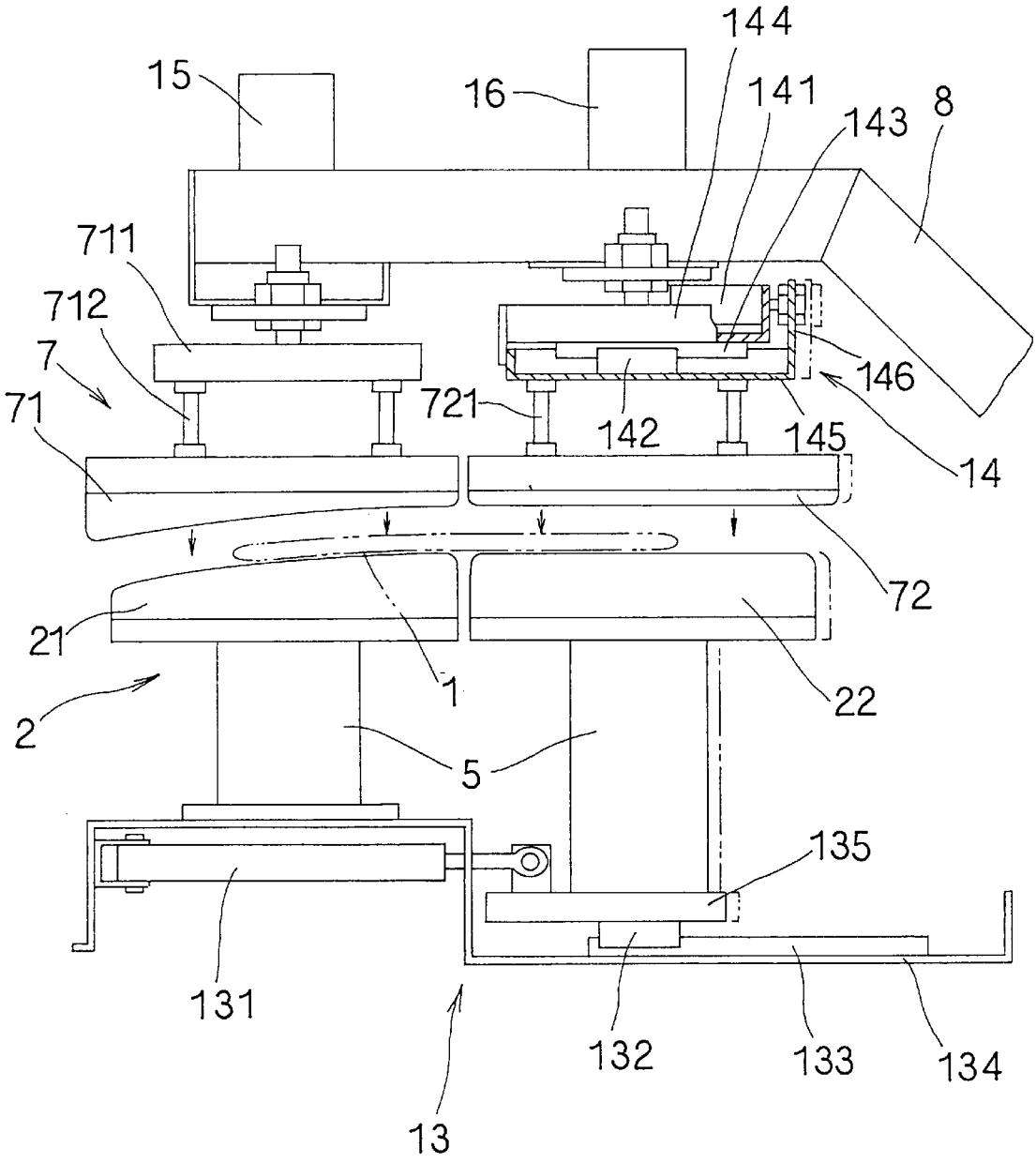
FIG. 6 is a side elevational view for showing a substantial part with a part of the machine being broken away.

As shown in FIG. 6, the aforesaid operating mechanism 13 is formed to be provided with a slider 132 and a guide rail 133 in addition to the air cylinder 131. As the air cylinder 131, one having a long stroke is selected and this is fixed to a fixing plate 134 in a horizontal orientation. The extremity end of the rod in the air cylinder 131 is connected to the plate 135. The plate 135 is fixed to the leg 5 of the rear-side pressing table 22. The slider 132 is fixed to the lower surface of the plate 135 and formed to be slid in a lateral direction along the guide rail 133. The guide rail 133 is fixed to the upper surface of the fixed plate 134. In addition, this guide rail 133 is formed to be elongated in a forward or rearward direction of the device, the rear-side pressing table 22 can be mounted while it is being spaced apart widely in a rearward direction from the front-side pressing table 21. This is due to the fact that the front-side pressing table 21 can be easily utilized as an ironing table.

As shown in FIG. 6, the aforesaid operating mechanism 14 is formed to be provided with a slider 142 and a guide rail 143 in addition to the air cylinder 141. The air cylinder 141 is fixed to the fixing part 144 in a horizontal orientation. The slider 142 is fixed to the upper surface of the operating section 145. The guide rail 143 is fixed to the lower surface of the fixing part 144 along the extending or retracting direction of the rod of the air cylinder 141. The slider 142 is formed to be slidable along the guide rail 143 in a lateral direction together with the operating part 145. The extremity end of the rod of the air cylinder 141 is fixed to the raising plate 146 of the operating part 145.

In addition, the rear-side pressing iron 72 is arranged at the operating part 145 through a fixing lever 721. Additionally, the front-side pressing iron 71 is arranged at a base part 711 through a fixing lever 712. Reference numeral 15 denotes an air cylinder for moving up or down the front-side pressing iron 71. Each of the air cylinders 15, 16 is arranged at the upper part of the support 8 with the rod being faced downwardly.

Operation of the present invention will be described as follows.

Figure 5:
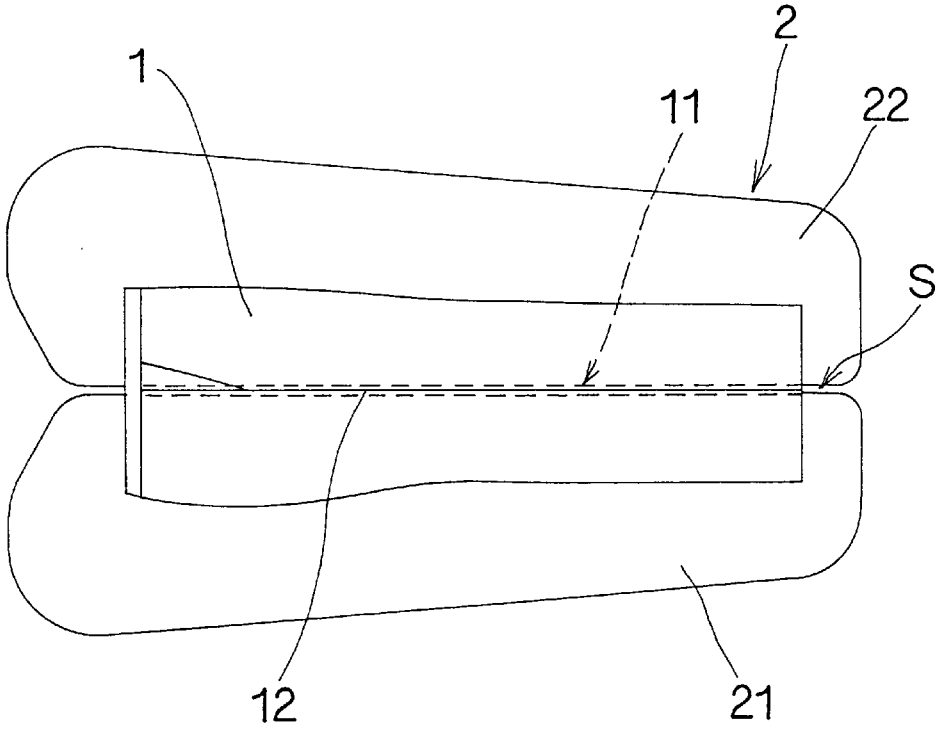
FIG. 5 is a top plan view for showing a substantial part of a mounted state of the trousers.

At first, an operator mounts the trousers 1 on the upper surfaces of the front-side pressing table 21 and the rear-side pressing table 22. In this case, the operator, as shown in FIGS. 1B and 5, arranges the overlapped portions 11 of the trousers 1 along the clearance S.

Next, the operator drives the driving means 9. Then, the support 8 is turned to the front side of the device, resulting in that the front-side pressing iron 71 and the rear-side pressing iron 72 are arranged just above the front-side pressing table 21 and the rear-side pressing table 22 as shown in FIG. 1A. In the case of the preferred embodiment of the present invention, the air cylinders 15, 16 are driven under this state so as to press the trousers 1.

The present invention is operated such that the air cylinder 131 and the air cylinder 141 shown in FIG. 6 are driven concurrently during this pressing time, their rods are slightly extended only by the same length. As a result, the rear-side pressing table 22 and the rear-side pressing iron 72 are slightly moved in a rearward direction while one side of the trousers 1 is being pressed. In addition, during the pressing time, heated air is supplied by the blower 3 to the front-side pressing table 21 and the rear-side pressing table 22.

Then, as a predetermined time elapses, the driving means 9 is operated again. In the case of this preferred embodiment, the rod of only one air cylinder 91 is retracted. As a result, the support 8 in FIG. 1 is turned in a rearward direction only by an angle Φ2, each of the pressing irons 71, 72 is moved away from each of the pressing tables 21, 22.

The operator removes the trousers 1 when the support 8 is turned in a rearward direction and each of the pressing irons 71, 72 is moved away from each of the pressing tables 21, 22. As the support 8 is turned in a rearward direction, the rods of the air cylinders 131, 141 are retracted, resulting in that the rear-side pressing table 22 and the rear-side pressing iron 72 are moved slightly in a forward direction and then returned back to their original states.

Then, the case in which the front-side pressing table 21 is used as the iron table will be described. In this case, as shown in FIG. 8, the operator at first causes both rods of one air cylinder 91 and the other air cylinder 92 to be retracted. Then, the support 8 is turned in a rearward direction only by an angle Φ1, and the pressing iron 7 is arranged at a rearward location.

Then, the operator extends the rod of the air cylinder 131 in an elongated state. Then, the rear-side pressing table 22 is retracted in a rearward direction along the guide rail 133 and moved away from the front-side pressing table 21. As a result, the upper part of the front-side pressing table 21 is released. Accordingly, the operator performs the ironing operation under utilization of the front-side pressing table 21.

Although the present invention has been described with reference to the preferred embodiments, it is apparent that the present invention is not limited to the aforesaid preferred embodiments, but various modification can be attained without departing from its scope.

What is claimed is:

1. A pressing machine for trousers comprising:

a pressing table for mounting trousers thereon and a support including a pressing iron for pressing an upper surface of the pressing table, wherein said pressing table is formed by a front-side pressing table and rear-side pressing table arranged side-by-side with a clearance therebetween for use in arranging overlapped portions of the trousers, said pressing iron is formed by a front-side pressing iron positionable in alignment with the front-side pressing table and a rear-side pressing iron positionable in alignment with the rear-side pressing table;

an operating means for displacing the rear-side pressing table and the rear-side pressing iron in a rearward direction from the front-side pressing table and the front-side pressing iron so as to make taut the trousers during the pressing of the trousers, the operating means formed by a first operating mechanism provided with an air cylinder for sliding the rear-side pressing table in the rearward direction and a second operating mechanism provided with an air cylinder for sliding the rear-side pressing iron in a rearward direction;

the support having an upper part provided with the front-side pressing iron and the rear-side pressing iron, that is capable of being turned in a forward or rearward direction and a turning means for turning the upper part in two ways of a large angle and a small angle in a forward direction toward the pressing table or in a rearward direction away from the pressing table, the turning means formed by a pair of air cylinders including a pair of rods, the rods having extremity ends connected between the air cylinders and the support, wherein when the air cylinder of the operating mechanism for the rear-side pressing table is positioned in an elongated stroke state, the rear-side pressing table is spaced apart from the front-side pressing table and can be installed or removed from the pressing machine as needed.

2. A pressing machine for trousers according to claim 1, wherein there is provided a blower for supplying heated air to the front-side pressing table and the rear-side pressing table and an extending or retracting bellows section is formed at an aeration passage extending from the blower to the rear-side pressing table.

* * * * *